United States Patent [19]

Lundberg

[11] 4,279,212

[45] Jul. 21, 1981

[54] ASSEMBLY FOR TREATING VESSEL HULLS

[75] Inventor: Hans G. Lundberg, Löddeköpinge, Sweden

[73] Assignee: Marinkonsult Hans Lundberg AB, Trelleborg, Sweden

[21] Appl. No.: 43,564

[22] Filed: May 29, 1979

[30] Foreign Application Priority Data

Jun. 1, 1978 [SE] Sweden ..... 7806437

[51] Int. Cl.[3] ..... B63B 59/00

[52] U.S. Cl. ..... 114/222; 114/270; 134/180

[58] Field of Search ..... 114/222; 134/180, 181

[56] References Cited

U.S. PATENT DOCUMENTS

| | | | |
|---|---|---|---|
| 699,144 | 5/1902 | Burt | 114/222 |
| 919,939 | 4/1909 | Otidys | 114/222 |
| 2,831,451 | 4/1958 | May | 114/222 |
| 3,951,092 | 4/1976 | van den Broek | 114/222 |
| 4,084,535 | 4/1978 | Rees | 114/222 |
| 4,102,290 | 7/1978 | Weiss | 114/222 |

FOREIGN PATENT DOCUMENTS

| | | | |
|---|---|---|---|
| 1294011 | 10/1972 | United Kingdom | 114/222 |

*Primary Examiner*—Trygve M. Blix
*Assistant Examiner*—D. W. Keen
*Attorney, Agent, or Firm*—Edwin E. Greigg

[57] ABSTRACT

An assembly for cleaning ships' hulls of such marine growth as seaweed, shell etc. is disclosed. The assembly has a frame with rotating brushes, the frame being reciprocally pivotal over the hull in an arcuate direction by being connected to one end of an arm or the like. The other end of the arm is pivotally connected to a joint which forms a stationary point for the assembly.

10 Claims, 7 Drawing Figures

ASSEMBLY FOR TREATING VESSEL HULLS

The present invention relates to an assembly for treating, primarily cleaning, underwater surfaces of fixed or floating constructions, for example ships' hulls, the assembly having a frame which supports at least one motor-driven, rotatable treatment device which may be moved into abutment against the construction surfaces.

Such assemblies are normally used for the removal of marine growth, for example seaweed, shells, etc. on ships' hulls, oil drilling platforms etc, the assemblies being normally either remote-controlled or diver-operated.

In remote-controlled assemblies, one great problem is that the operator has poor supervision over the work being carried out. For supervising the work being carried out, it is necessary to send down a diver for visual checking of the work and, in such an instance, often touch up the work on those surfaces which have been missed or which have been insufficiently cleaned. Consequently, the entire treatment will be both time-consuming and expensive.

In the majority of attempts to solve this problem, the normal practice has, therefore, been to send down one or more divers during the entire operation for continuously following and, to a certain extent, guiding the assembly during its work. This entails, in turn, that the divers, being few in number, must be down for long periods of time. If there are several divers, these may take it in turns at the working site, but such a large number of divers renders the operation rather expensive.

As an alternative to having the divers simply follow and supervise the assembly, the assemblies may be of such dimensions that the divers may operate them directly, one example of such a diver-operated assembly being shown and described in Swedish patent specification (patent application No. 7612280-3). These diver-operated assemblies possess, because of their ease of movement and simplicity of operation, obvious advantages as regards cleaning relatively small surfaces which may also often be of complex form and contour. However, with such diver-operated assemblies, it takes rather a long time to clean such great surfaces as may be involved in modern tankers with a dead weight of several hundred thousand tons.

The object of the present invention is to realise an assembly which is effective for cleaning relatively large surface areas and which, for its operation, does not require diver supervision but operates more or less fully automatically.

This object is attained according to the invention in that the frame is connected to one end of an elongate member which, at its other end, is pivotally connected to a joint which is substantially stationary with respect to the frame and the construction and is connected to a moveable unit which supports the frame and the member, the treatment device treating mutually subsequent portions of the construction as a result of the pivoting of the member and the movement of the unit.

The nature of the present invention and its aspects will more readily understood from the following brief description of the accompanying drawings, and discussion relating thereto.

In the accompanying drawings:

FIG. 1 schematically illustrates, seen from the outside in a direction towards a ship's hull, a first preferred embodiment of the invention and its use;

FIG. 2 schematically illustrates, partly in section, a feature of the assembly according to FIG. 1;

Figure 1:
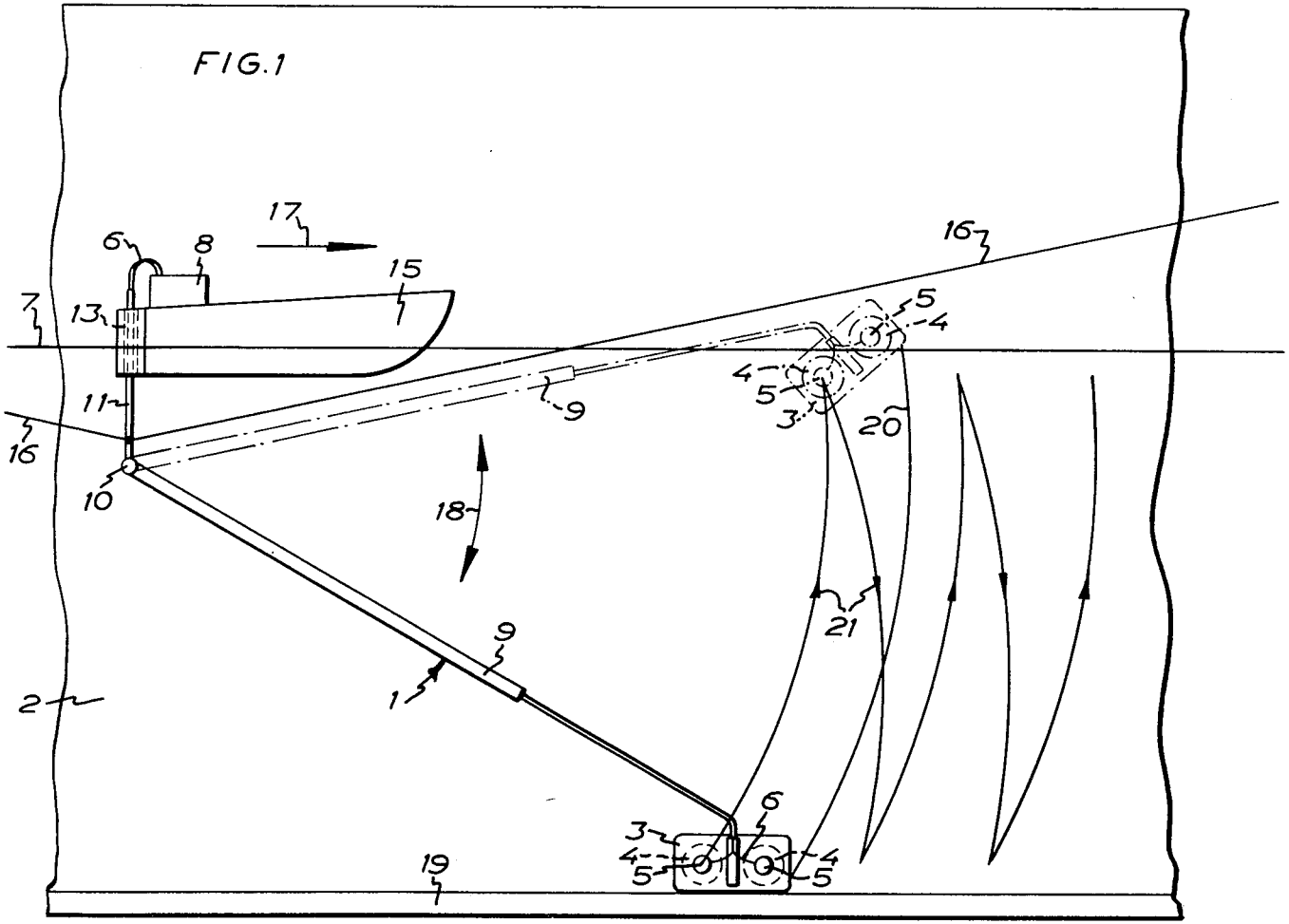

The assembly shown on the drawings and generally designated 1 is primarily intended for the cleaning of ships' hulls 2 below the water line and is, more precisely, particularly intended for the removal of such marine growth as seaweed, shell etc. on such hulls. A portion of the vertical side of the hull 2 is shown on the drawings, but the assembly 1 may, without modification (or with but minor modifications) be used for cleaning the underside of the hull.

The assembly 1 has a frame 3 in which two circular brushes 4 having preferably mutually overlapping paths of movement are mounted, the brushes 4 each being driven by its hydraulically, electrically or pneumatically driven motor 5. The motors 5 are connected by the intermediary of suitable hoses 6 to a power source 8 disposed above the water line. The brushes 4 may, in a conventional manner, be provided with a hard brushing attachment which is moveable into abutment with the hull 2 for cleaning thereof. Alternatively, one or both brushes 4 of the assembly 1 may be designed in the manner illustrated in FIGS. 6 and 7, this embodiment being described below.

Figure 2:
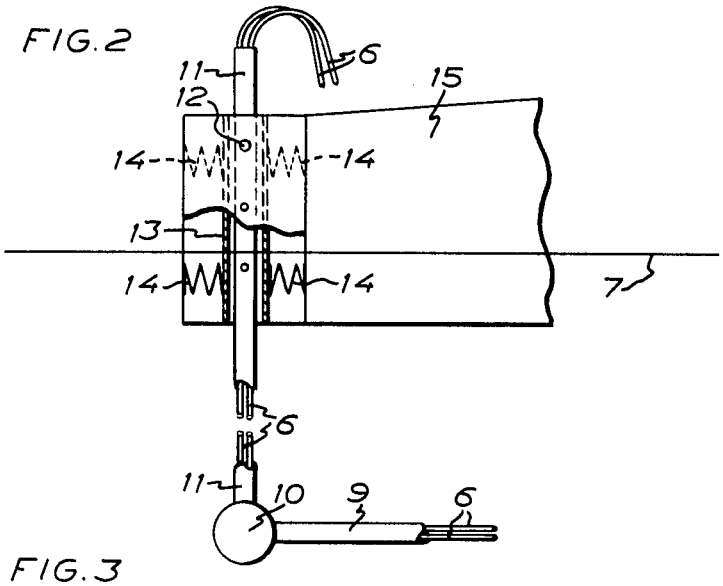
Figure 3:
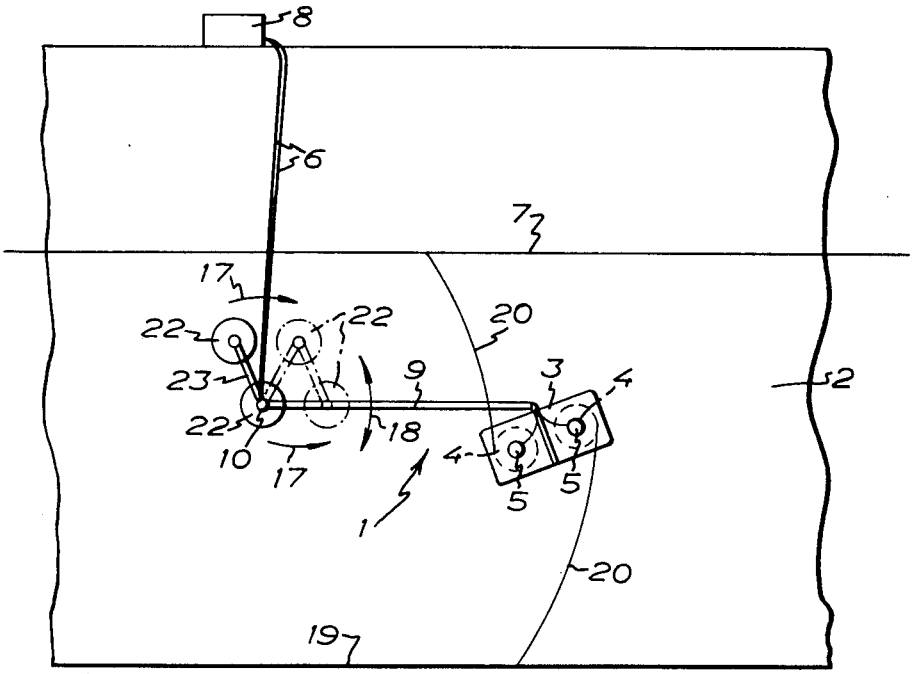
FIG. 3 shows, in a projection corresponding to FIG. 1, a second preferred embodiment of the assembly according to the invention and its use.

In the embodiments according to FIGS. 1–3, the frame 3 is connected to one end of an elongate member in the form of an arm 9 which, in the embodiment illustrated in FIGS. 1 and 2, may be of variable length in that it is, for example, telescopic, the arm 9 being typically variable in length from about 5 m to about 20 m. At its other end, the arm 9 is pivotally connected to a joint 10 which, in the embodiment illustrated in FIGS. 1 and 2, is disposed on the lower end, located below the water line 7, of a substantially vertically directed bar 11. The bar 11 is, by means of a suitable device, for example a bolt 12 (please see FIG. 2), axially shiftably fixable in a guide 13, here in the form of a sleeve surrounding the bar 11. The guide 13 may, for purposes which will be described below, be resiliently biased by means of springs 14 to a centered position. The guide 13 is, by the intermediary of the spring 14, connected to a moveable unit 15 supporting the frame 3, the arm 9, the joint 10 and the bar 11, this unit in the embodiment shown in FIGS. 1 and 2 being a boat. The bar 11 is moveable in the direction of the arrow 17 by means of cables 16 (which are anchored in a suitable manner, not shown, in appropriate points on the hull 2) or by means of some other suitable aid. The arm 9 extends substantially horizontally in a forward direction from the joint 10 seen in the direction of movement 17 and is, together with the frame 3 and the brushes 4 supported thereby, pivotal upwardly and downwardly in the direction of the double arrow 18. The brushes 4, after an operative cycle from above on a level with the water line 7 (please see the position in FIG. 1 indicated by dash-dot lines), downwardly to a level with the bilge 19 of the vessel, and upwardly again to the position indicated by dash-dot lines, are moved, by movement of the boat 15 in the direction of the arrow 17, forwardly a distance, for example, corresponding to the common operative width of the two brushes 4. In this manner, the brushes 4 will treat mutually subsequent arcuate portions or surfaces of the hull 2, the demarcation line between treated and untreated hull being shown by means of an arc line 20. The surface area to the left of the arc line 20 is, thus, treated, whereas the surface area to the right of this line is still untreated. Alternatively, the brushes 4 may, during their downward and upward movement, be slowly moved continuously in a forward direction following the arrow 17, the left-hand brush according to FIG. 1 following the path shown by upwardly and downwardly directed arrows 21. Since the right-hand brush 4 according to FIG. 1 protrudes somewhat above the water line 7, it is possible to maintain a continuous supervision of the work of the assembly 1 from a position above the water line 7, in other words it is possible continuously to check that the brushes have not missed treating a portion of the hull 2 or do not treat the same area several times.

In order to realize the upward and downward movement of the brushes 4 between the extreme positions, the brushes 4 are rotated in such a manner that, in the extreme positions, the direction of rotation of the brushes is reversed such that they, by their abutment against the hull 2, will drive the frame 3 and, therewith, the arm 9 upwardly and downwardly. As a complement or alternative hereto, the angle of inclination of the brushes 4 against the plane of the hull 2 may be adjusted such that the they abut tighter against the hull with one portion of their periphery and, in such a manner, create an upwardly or downwardly directed driving force.

A conceivable line of connection between the centers of rotation of the two brushes 4 suitably makes an angle of the order of magnitude of 30° with respect to the arm 9. The reason for this is that the brushes 4, in the lower extreme position, shall operate effectively right down to the bilge 19 and not leave any untreated surface areas. As a result of this angle, the advantage will also be obtained that the right-hand brush 4 according to FIG. 1 will, in the upper extreme position, protrude somewhat above the water line 7, this property facilitating, as was mentioned above, observation of the treated surface area from a place above the water line.

In order to determine the upper and lower extreme positions of the assembly 1, there is suitably provided on the frame 3 a pressure sensor (not shown) which, by sensing maximum pressure (lower extreme position) and minimum pressure (upper extreme position) reverses the direction of rotation of the brushes 4 and/or their angular position with respect to the plane of the hull 2. However, the upper and lower extreme positions may be determined in many other ways, for example by means of limit switches which strike fixed fittings on the hull 2.

Since the brushes 4 attach themselves by suction to the hull 2 with a force which is dependent on the supply of the "lubricating" compressed air, the various components included in the assembly 1 could be damaged if this assembly were rigidly connected to the boat 15, since the boat must, as a natural result of its floating on the surface 7 of the water, follow the movements of the waves. It is primarily for this reason that the assembly 1, and more precisely the bar 11, is connected to the boat 15 by the intermediary of the springs 14. Alternatively, the bar 11 may, for this purpose, in itself be resiliently yieldable.

In the embodiment according to FIG. 3, there are to be found the assembly components consisting of the frame 3, the brushes 4, the motors 5, the hoses 6, the power source 8, the arm 9 and the joint 10. This embodiment differs from the embodiment of FIGS. 1 and 2 in that the joint 10 is not connected, by the intermediary of a bar 11, to a boat floating on the surface of the water, but is connected to two suction cups 22 which are located in spaced apart relationship and are interconnected by means of a rod 23 or the like. After each operative cycle of the brushes 4 downwardly and upwardly, the suction cups 22 are maneuvered by means of suitable valves and motors (not shown) in such a manner that they are alternatingly moveable in the direction of movement 17 to a new position corresponding to the total working width of the brushes. This new position is shown by means of broken lines in FIG. 3. Instead of using suction cups 22, it is possible to use alternatingly moveable electromagnets, but in practice suction cups have proved to be superior, since they realise a better and more reliable adhesion to the hull 2.

Figure 4:
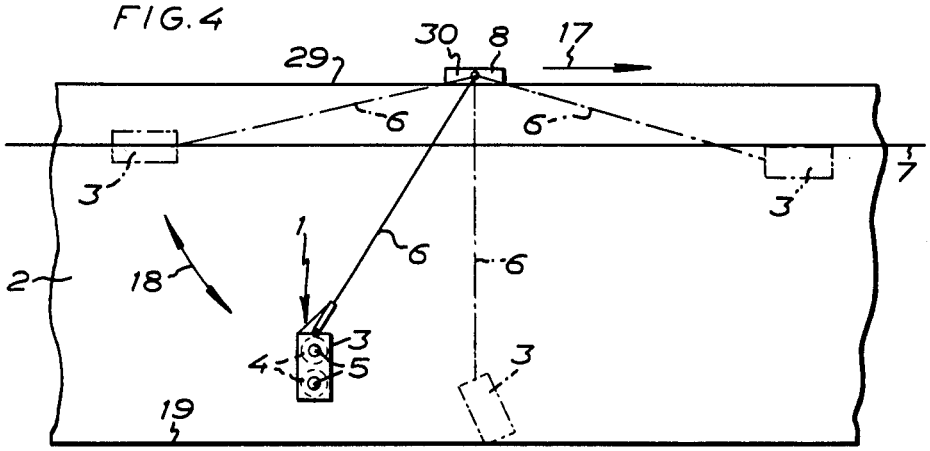
FIG. 4 shows, in a projection corresponding to FIG. 1, a third preferred embodiment of the assembly according to the invention and its use.
Figure 5:
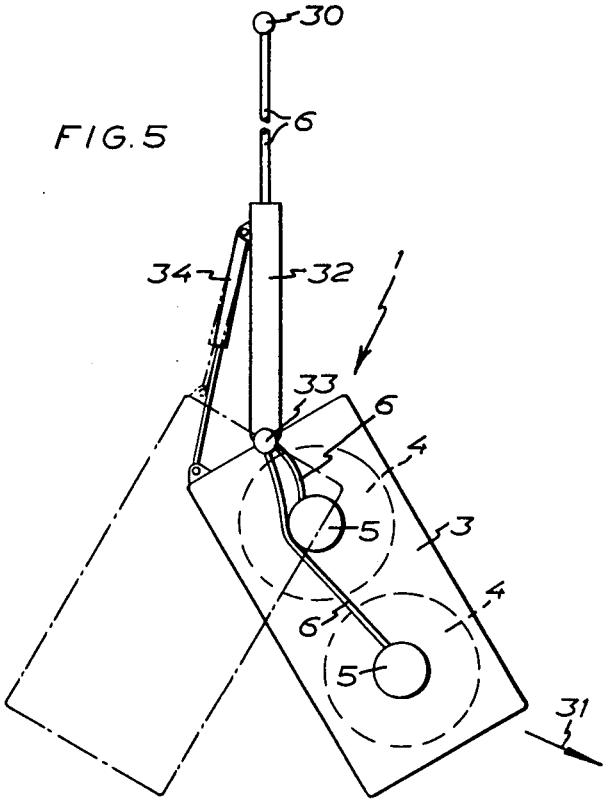
FIG. 5 shows the assembly of FIG. 4, but in greater detail.

In the embodiment of the assembly 1 according to the invention, shown in FIGS. 4 and 5, the components corresponding to those in the embodiments according to FIGS. 1–3 have the same reference numerals. Thus, this embodiment includes the frame 3, the brushes 4, the motors 5, the hoses 6 and the power source 8. However, this embodiment lacks the arm 9, the joint 10 and the bar 11 and, instead, the frame 3 with associated parts is pendulum-suspended in the hoses 6 proper, these being sufficiently strong to withstand this suspension. Alternatively, or as a complement, a cable (not shown) may support the frame 3. The hoses 6 are, at their end distal from the frame 3, connected to a unit 30 which is moveable along the gunwale 29 of the vessel in the direction 17. This unit may also suitably carry the power source 8. A pendulum movement of the frame 3 to and fro between the limit positions shown by broken lines in FIG. 4 is realized, as in the earlier-described embodiments, by means of the driving engagement of the brushes 4 with the hull 2, the pendulum direction being dependent upon the direction of rotation of the brushes and/or their inclination with respect to the plane of the hull 2. Since the hoses 6 are flexible, it is necessary to ensure, during the pendulum movements of the frame 3, that the hoses are kept taut, since, if they were allowed any amount of slack, this would result in parts of the hull 2 possibly remaining untreated. In order to keep the hoses 6 taut, it is possible, by pivoting the frame 3 with respect to the hoses 6, to create an outward driving force, as shown by means of the arrow 31 in FIG. 5. This pivoting is realized in that a pipe 32 or the like forms a passage for the hoses 6 and is, at its end, pivotally connected by means of a joint 33 to the frame 3 at a point thereon which is suitably located centrally of its one short side (please see FIG. 5), a hydraulic or pneumatic cylinder 34 being pivotally connected at its ends to the frame 3 and the pipe 32. By actuation of the cylinder 34, the frame 3 is pivoted with respect to the pipe 32, and, consequently, the hose section 6 between the pipe 32 and the unit 30, the total angle of pivot amounting to approximately 60°. In the pivotal position of the frame 3 shown by means of solid lines in FIG. 5, the brushes 4 drive the frame to the right, whereas, in the pivotal position shown by means of dash-dot lines in the same figure, they drive the frame 3 to the left.

For purposes of sensing treated/cleaned portions of the hull 2, a transducer (not shown) may be provided in each corner of the frame 3, in which instance these transducers may, in one embodiment, consist of transformers whose core is supplemented by the plating of the hull 2. The secondary voltage through the transformers varies with the distance to the plating, which voltage may be measured. Alternatively, an oscillation circuit may be provided for the above-disclosed sensing operation, in which the phase shifting or frequency between two oscillations varies in dependence upon the distance to the hull plating.

In the illustrated and described embodiments, the assembly 1 has two brushes 4, but, naturally, there is nothing to prevent the number of brushes from being increased according to desire and need.

Figure 6:
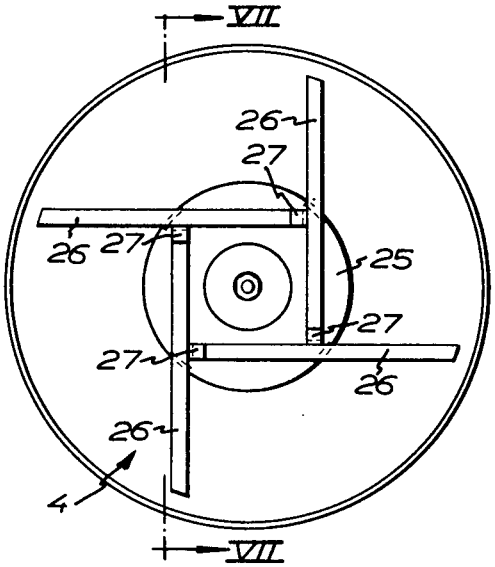
FIG. 6 shows one embodiment of a treatment device included in the assembly according to the invention, seen from that side thereof which is turned to face the portion or surface which is to be treated.
Figure 7:
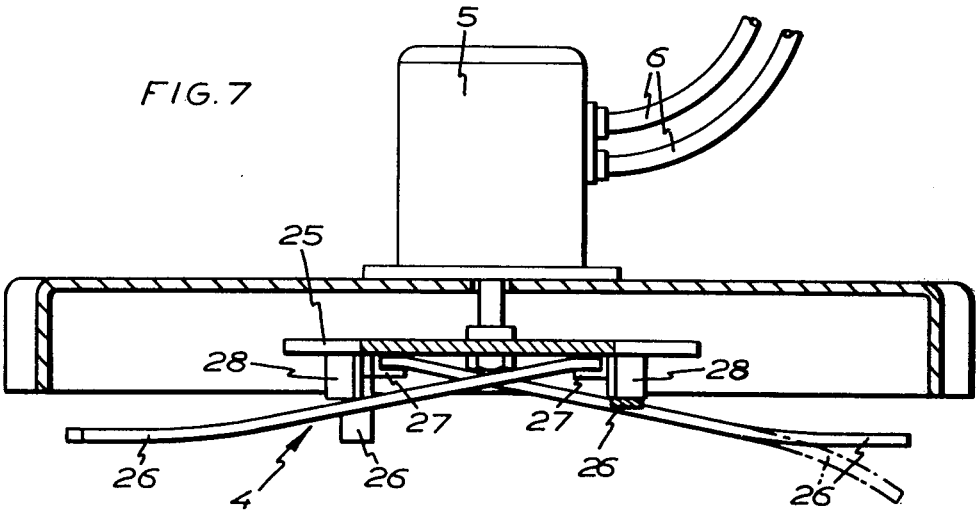
FIG. 7 is a section taken along the line VII—VII in FIG. 6.

As was mentioned earlier, the brushes 4 are suitably of the construction which is shown and described in Swedish patent specification (Application Number 7612280-3), but if the growth on the hull of the vessel is so extensive or hard, for example shell, that these brushes are not capale of cleaning the hull effectively, one or both brushes 4 of the assembly 1 may have the construction which is shown in FIGS. 6 and 7. The brush (or perhaps more precisely scraper 4) shown in these Figures is formed of a holder 25 which is non-rotatably mounted on the drive shaft of the motor 5. The holder 25 mounts four radially outwardly directed scraper vanes 26 which are manufactured of resiliently yieldable material, suitably spring steel. The scraper vanes 26 are, at their inner end, each releasably mounted on a bracket 27 fixedly disposed on the holder 25, and each abut, intermediate of their ends, against a support 28 projecting from the holder 25. In this manner, the scraper vanes 26 yield resiliently, with the support 28 as a fulcrum when they are compressed against the vessel hull 2. At the bottom to the left in FIG. 5, dash-dot lines show the course of a scraper vane in the unbiased state, that is to say when it is not compressed against the hull, a state which, on the other hand, is shown by means of solid lines in the same Figure. The scraper according to FIGS. 6 and 7 has been illustrated with four scraper vanes 25, but there is, naturally, nothing to prevent a number of wings from being varied upwardly or downwardly.

Naturally, the invention should not be considered as restricted to the embodiments described above and shown on the drawings, many modifications of the invention being possible within the spirit and scope of the accompanying claims. For example, not only the number of brushes 4 but also their construction may be optionally varied and they may be, for example, cylindrical instead of circular.

What I claim and desire to secure by Letters Patent is:

1. An assembly for treating underwater surfaces of fixed or floating constructions, for example, ships' hulls, the assembly having a frame which supports at least two motor-driven, rotatable treatment devices which are moveable into abutment against the construction surfaces, wherein the frame is connected to one end of an elongate member which, at its other end, is pivotally connected to a joint which, in the treatment, is substantially stationary with respect to the frame and the construction and is connected to a vessel floating on the surface of the water, which supports the frame and the elongate member and which is moveable along the construction surfaces in a forward direction, wherein said joint is located beneath the water line and is attached to an anchorage which is resiliently connected to said vessel by spring means, wherein said elongate member extends substantially horizontally forwardly from said joint and is pivotable between a lower position at which the frame is disposed below the joint and an upper position at which the frame is disposed above the joint adjacent the water line, and wherein said at least two treatment devices are inclined somewhat with respect to the abutting surface of the construction being treated, such that said treatment devices produce a force for their own driving reciprocally between said upper and lower positions, said treatment devices treating mutually subsequent portions of the construction surfaces as a result of the driving of the treatment devices and the movement of the vessel.

2. The assembly as recited in claim 1, wherein said anchorage is a substantially vertically directed bar which is guided in a guide mounted on said vessel and is axially shiftably fixable in said guide.

3. An assembly for treating underwater surfaces of fixed or floating constructions for example, ships' hulls, the assembly having a frame which supports at least one motor-driven, rotatable treatment device which is moveable into abutment against the underwater construction surfaces, wherein the frame is connected to one end of an elongate member which, at its other end, is pivotally connected to a joint which, in the treatment, is substantially stationary with respect to the frame and the construction and is connected to a moveable unit which supports the frame and the member, said at least one treatment device treating mutually subsequent portions of the underwater construction surfaces as a result of pivoting of the member and movement of the unit along the construction surfaces in a selected direction, wherein said moveable unit comprises at least two engaging devices which are moveable into releaseably retentive engagement with the construction and are alternatingly moveable in said selected direction of movement.

4. The assembly as recited in claim 3, wherein said engaging devices comprise suction cups.

5. The assembly as recited in claim 3, wherein said frame supports at least two treatment devices each driven by its motor and inclined somewhat with respect to the abutting portions of the construction surfaces, such that said treatment devices produce a force for their own driving reciprocally along the mutually subsequent portions of the construction.

6. The assembly as recited in claim 5, wherein the direction of rotation of said treatment devices is reversible for alternatingly driving said frame reciprocally.

7. The assembly as recited in claim 3, wherein at least one of said treatment devices is formed of a holder which is non-rotatably mounted on the drive shaft of the motor and supports a plurality of radially outwardly directed scraper vanes which are compressible against those portions of the construction surfaces which are to be treated.

8. The assembly as recited in claim 7, wherein said scraper vanes are made of a resiliently yieldable material and, are at their inner end, each mounted on a bracket disposed on said holder, and each abut intermediate of their ends against a support projecting from said holder, said vanes, on compression againt the parts of the construction which are to be treated, resiliently yielding, with the support acting as a fulcrum.

9. The assembly as recited in claim 5, wherein the angle of inclination of said treatment devices is adjustable for alternatingly driving said frame reciprocally.

10. The assembly as recited in claim 5, wherein the direction of rotation of said treatment devices is reversibe and the angle of inclination of said treatment devices is adjustable.

* * * * *